US011406993B2

(12) United States Patent
Comstock et al.

(10) Patent No.: US 11,406,993 B2
(45) Date of Patent: Aug. 9, 2022

(54) NOZZLE ADAPTER FOR 3-WAY LIQUID SPRAY NOZZLE

(71) Applicant: The Fountainhead Group, Inc., New York Mills, NY (US)

(72) Inventors: Marty Comstock, New York Mills, NY (US); David Denmat, Clinton, NY (US); Justin Deschamps, Boonville, NY (US); Matthew Merritt, Oneida, NY (US); Mario Restive, Frankfort, NY (US); Jeffrey Spooner, West Winfield, NY (US); John Vaughan, Waterville, NY (US)

(73) Assignee: The Fountainhead Group, Inc., New York Mills, NY (US)

( * ) Notice: Subject to any disclaimer, the term of this patent is extended or adjusted under 35 U.S.C. 154(b) by 0 days.

(21) Appl. No.: 16/806,281

(22) Filed: Mar. 2, 2020

(65) Prior Publication Data

US 2020/0276595 A1 Sep. 3, 2020

Related U.S. Application Data

(60) Provisional application No. 62/812,530, filed on Mar. 1, 2019, provisional application No. 62/814,101, filed on Mar. 5, 2019.

(51) Int. Cl.
*B05B 1/12* (2006.01)
*B05B 1/16* (2006.01)

(52) U.S. Cl.
CPC ..... *B05B 1/1654* (2013.01); *B05B 1/12* (2013.01)

(58) Field of Classification Search
CPC ..... B05B 1/1654; B05B 1/12
USPC ..... 239/392
See application file for complete search history.

(56) References Cited

U.S. PATENT DOCUMENTS

| | | | | |
|---|---|---|---|---|
| 4,347,025 | A * | 8/1982 | Long | F16L 19/005 239/600 |
| 4,640,534 | A * | 2/1987 | Hoskins | F16L 37/0885 285/143.1 |
| 5,161,716 | A * | 11/1992 | Knickerbocker | B05B 11/0029 222/153.1 |
| 5,447,342 | A * | 9/1995 | Mazhar | F16L 27/125 285/307 |
| 5,657,525 | A * | 8/1997 | Hoyt, III | F16D 3/54 29/407.01 |
| 6,085,998 | A * | 7/2000 | Yokoyama | B05B 1/005 239/600 |
| 9,694,379 | B2 | 7/2017 | Byrne et al. | |

FOREIGN PATENT DOCUMENTS

| | | |
|---|---|---|
| DE | 2611424 | 9/1977 |
| EP | 3332877 | 6/2018 |
| WO | WO 2017173481 | 10/2017 |

OTHER PUBLICATIONS

International Search Report Form PCT/ISA/220, International Application No. PCT/US2020/020635, pp. 1-16, dated May 28, 2020.

* cited by examiner

*Primary Examiner* — Chee-Chong Lee
(74) *Attorney, Agent, or Firm* — George R. McGuire; Bond Schoeneck & King, PLLC

(57) ABSTRACT

A nozzle adapter/attachment includes features that facilitate use and protects the user from possible fluid exposure. The nozzle attachment is configured with features that both align and clamp onto an existing nozzle. In one embodiment, there are three sets of alignment and clasping features.

13 Claims, 5 Drawing Sheets

NOZZLE ADAPTER FOR 3-WAY LIQUID SPRAY NOZZLE

CROSS-REFERENCE TO RELATED APPLICATION

This application claims priority to U.S. Provisional Patent Application Ser. Nos. 62/812,530 and 62/814,101, filed on Mar. 1, 2019 and Mar. 5, 2019, respectively and each entitled "NOZZLE ADAPTER FOR 3-WAY LIQUID SPRAY NOZZLE," the entire disclosure of each of which is incorporated herein by reference.

FIELD OF THE INVENTION

The present disclosure is directed generally to an adjustable 3-way nozzle for a liquid fluid sprayer, and more particularly to such a nozzle that prevents the sprayed fluid from contact with the user's fingers during spray pattern adjustment.

BACKGROUND

Lawn and garden sprayers typically employ an outlet nozzle that is manually adjustable, in order to set the fluid spray to the desired pattern. For an adjustable 3-way nozzle, manually turning the nozzle enables the user to adjustably vary the fluid outlet to form fan, stream, and cone spray patterns. Examples of such typical lawn and garden sprayers are shown in FIG. 1.

A disadvantage of the typical manual-adjustment spray nozzle is that the user must grasp the nozzle at a touch-point location that is very close to the fluid spray outlet, as shown in FIG. 2.

This typical touch-point location is disadvantageous because, when operating the sprayer, the sprayed fluid can drip and otherwise collect onto the surfaces that surround and comprise the nozzle outlet. The user's fingers, when grasping the nozzle to adjust the spray pattern, can thus become wet due to the unobstructed proximity of the touch point to the nozzle outlet. An example of a typical touch-point location is shown in FIG. 3. The touch point feature on this typical adjustable nozzle is seen to be proximal to the fluid outlet.

Accordingly, there is a need in the art for a nozzle adapter that permits a user to operate the nozzle but without the user's fingers contacting the liquid being dispensed.

SUMMARY

The present disclosure is directed to a nozzle attachment which comprises features that facilitate use and protects the user from possible fluid exposure.

The nozzle attachment is configured with features that both align and clamp onto an existing nozzle. In one embodiment, there are three sets of alignment and clasping features.

The features which comprise the nozzle attachment include: (A). Three ribbed or knurled diametrical touch point features that are located a predetermined distance away from the nozzle outlet. This location of the touch points at a distance from the nozzle outlet minimizes the possibility of fluid reaching each touch point. The proportionally large diameter intuitively indicates the touch points for nozzle adjustment and places the user's fingers at a radial distance away from the nozzle. The peripheral surface of the diametral touch point may be color-coded in order to further provide an intuitive indication of the touch point; (B). A rotation direction feature at each diametral touch point encourages correct rotation of the nozzle when setting the desired spray pattern; (C) Peripheral opening view features strategically located with respect to the setting indicators on the nozzle. These view features enable the operator to view the desired spray pattern setting while rotating the nozzle; (D). A bell-shaped outer feature around the nozzle outlet that discourages the user from touching or otherwise making contact with any wet surface around the nozzle outlet; (E). A bell-shaped inner feature that directs away from the user adjustment touch point any fluid drips and fluid collecting at the nozzle outlet; and (F). A drip edge feature on said bell that provides for any collected fluid along the inner surface of the bell to readily form and drop away from the user touch point.

According to an aspect is a nozzle adapter for secure placement on a nozzle having at least two spray apertures and corresponding alignment region that permit each of the spray apertures to be positioned for activation through rotation of the nozzle and alignment of the desired alignment region, the nozzle adapter comprising: (a) a body having proximal and distal portions that is sized, shaped, and adapted to be positioned in fixed relation to the exterior of the nozzle; (b) wherein the distal portion comprises: (i) at least one alignment element that engages with a corresponding alignment region of the nozzle; (ii) at least one clasping element that securely engages with the nozzle to fix the relative position of the nozzle adapted to the nozzle; and (iii) a ring element attached to the distal portion and extending circumferentially there-around and positioned radially outwardly from the alignment element and clasping element; (c) wherein the proximal portion is attached in laterally spaced relation to the distal portion by at least one outwardly tapering connector, and comprises at least two touch point regions that each terminate in an area that is raised relative to the remaining part of the area constituting the touch point and permits a user to rotate the nozzle adapter and nozzle to actuate any of the nozzle's spray apertures.

According to an embodiment, the distal portion comprises at least three alignment elements circumferentially spaced relative to one another, and at least three clasping elements circumferentially spaced relative to one another.

According to an embodiment, the alignment element comprises a spring biased tab that corresponds in position and size to contour and engage the nozzle.

According to an embodiment, the clasping element comprises a ridged flange sized, shaped, and positioned to snap over and engage the nozzle.

According to an embodiment, the ring element is bell-shaped and comprises a drip edge that diverts any liquid drips from the nozzle away from the user.

According to an embodiment, the touch point is textured.

According to an embodiment, the touch point is colored.

According to an embodiment, the proximal portion is of a proportionally larger diameter than the distal portion.

According to an embodiment, the proximal portion is attached in laterally spaced relation to the distal portion by at least three outwardly tapering connectors circumferentially spaced relative to one another such that the distance between the outwardly tapering connectors forms a viewing window.

According to an aspect, a nozzle adapter for secure placement on a nozzle having at least two spray apertures and corresponding alignment region that permit each of the spray apertures to be positioned for activation through rotation of the nozzle and alignment of the desired alignment region, the nozzle adapter comprises: (a) a body having proximal, distal, and ring portions, that is sized, shaped, and adapted to be positioned in fixed relation to the exterior of the nozzle; wherein the distal portion comprises: (i) at least one alignment element that engages with a corresponding alignment region of the nozzle; (ii) at least one clasping element that securely engages with the nozzle to fix the relative position of the nozzle adapted to the nozzle; (b) wherein the proximal portion is attached in laterally spaced relation to the distal portion by at least one outwardly tapering connector, and comprises at least two touch point regions that each terminate in an area that is raised relative to the remaining part of the area constituting the touch point and permits a user to rotate the nozzle adapter and nozzle to actuate any of the nozzle's spray apertures; (c) wherein the ring portion comprises: (i) an outer bell that is position such that it is a barrier to discourage users from grasping the distal portion; (ii) an inner bell positioned such that excess fluid on the nozzle drips into it; (iii) a drip edge positioned on the inner bell adapted to divert the excess fluid from the inner bell away from the user; and (d) wherein the ring portion is attached to the distal portion extending circumferentially there-around and positioned radially outwardly from the alignment element and clasping element.

According to an embodiment, the distal portion comprises at least three alignment elements circumferentially spaced relative to one another, and at least three clasping elements circumferentially spaced relative to one another.

According to an embodiment, the alignment element comprises a spring biased tab that corresponds in position and size to contour and engage the nozzle.

According to an embodiment, the clasping element comprises a ridged flange sized, shaped, and positioned to snap over and engage the nozzle.

According to an embodiment, the touch point is textured.

According to an embodiment, the touch point is colored.

According to an embodiment, the proximal portion is of a proportionally larger diameter than the distal portion and the ring portion.

According to an embodiment, the proximal portion is attached in laterally spaced relation to the distal portion by at least three outwardly tapering connectors circumferentially spaced relative to one another such that the distance between the outwardly tapering connectors forms a viewing window.

According to an aspect, provided is a method of applying a nozzle adapter for secure placement on a nozzle having at least two spray apertures and corresponding alignment region that permit each of the spray apertures to be positioned for activation through rotation of the nozzle and alignment of the desired alignment region, the nozzle adapter comprising, comprising the steps of: sliding the nozzle through the opening formed by the proximal portion of the nozzle adapter; positioning the alignment element such that it engages with a corresponding alignment region of the nozzle; and engaging the clasping element to ensure the nozzle adapter is securely fastened on to the nozzle.

According to an embodiment, the method comprises the further step of grasping the touch points of the proximal portion of the nozzle adapter.

According to an embodiment, the method comprises the further step of rotating the nozzle adapter until the nozzle is in the user's selected setting.

These and other aspects of the invention will be apparent from the embodiments described below.

BRIEF DESCRIPTION OF THE DRAWINGS

The present invention will be more fully understood and appreciated by reading the following Detailed Description in conjunction with the accompanying drawings, in which.

DETAILED DESCRIPTION OF EMBODIMENTS

Figure 1:
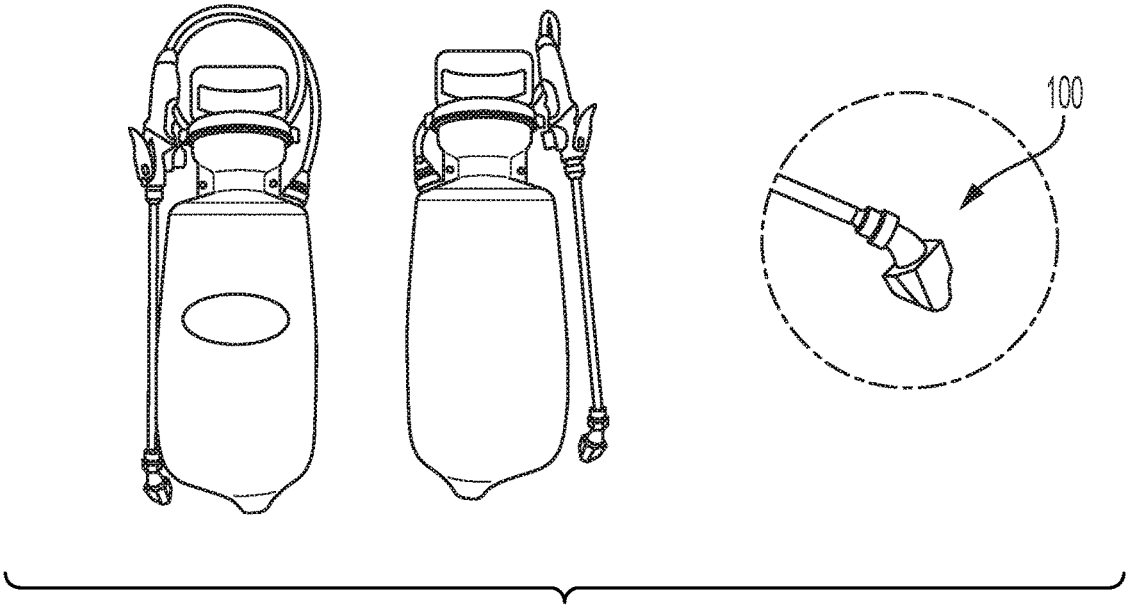
FIG. 1 PRIOR ART
FIG. 1 is prior art lawn and garden sprayers with manually adjustable nozzles.
Figure 2:
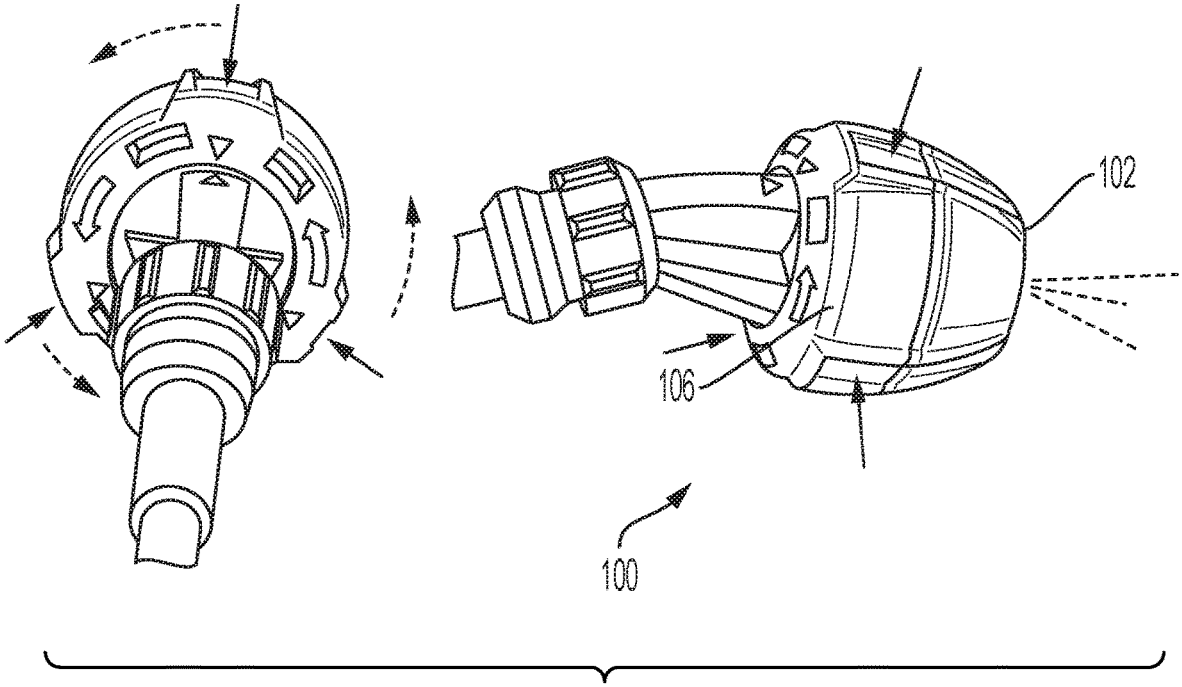
FIG. 2 PRIOR ART
FIG. 2 illustrates prior art touch points and pattern selection rotation requirement on typical 3-way lawn and garden sprayers with manually adjustable nozzles.
Figure 3:
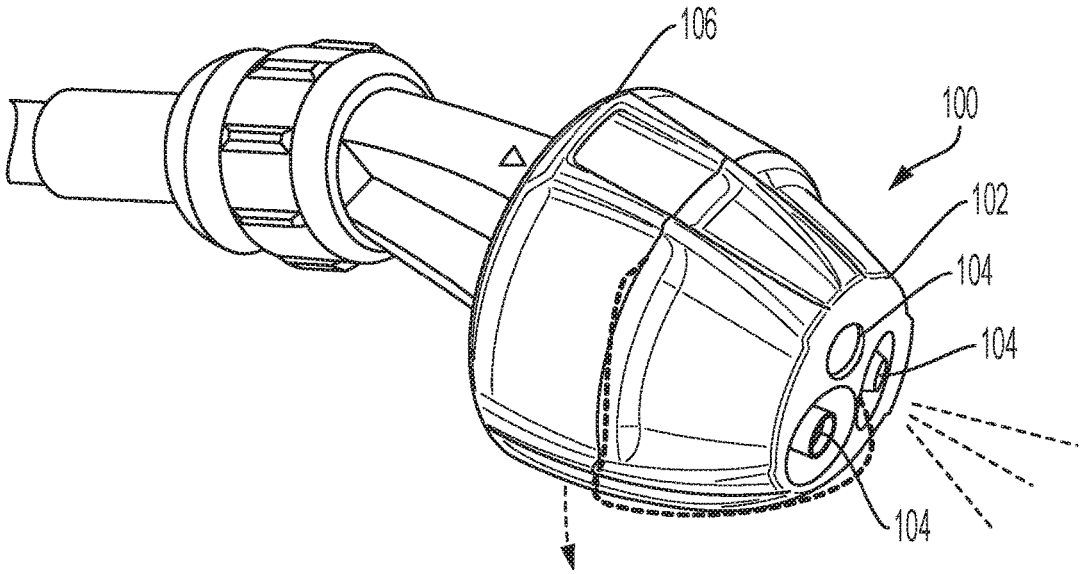
FIG. 3 PRIOR ART
FIG. 3 illustrates touch point feature on a prior art sprayer, showing fluid contamination.

The present disclosure describes a nozzle attachment which comprises features that facilitate use and protects the user from possible fluid exposure.

Before describing the nozzle attachment 10, the prior art nozzle 100 used in conjunction with the preferred embodiment should be understood. Nozzle 100 comprises outlet end 102 from which fluid is dispensed. It is a conically shaped nozzle tapering inwardly from its proximal end towards its distal end. Three nozzle outlets 104 are formed through nozzle outlet end 102 any one of which can be aligned with the nozzle to dispense fluid therefrom (while the others are not in fluid communication with the fluid source and thus are blocked from dispensing fluid). To align the desired nozzle outlet 104 the user would simply rotate the nozzle 100 about its longitudinal axis until the desired nozzle outlet clicks into aligned and engaged relation in a manner that is well understood in the art. Indicia formed or printed on the user facing end of the nozzle 100 provides visual indication as to the spray pattern associated with each nozzle outlet 104. A ridge 106 is formed about the circumference/perimeter of the user facing end and a series of longitudinally extending ribs 108 segment the body of the nozzle 100 in general accordance with the location of the three outlet nozzles 104.

Figure 4:
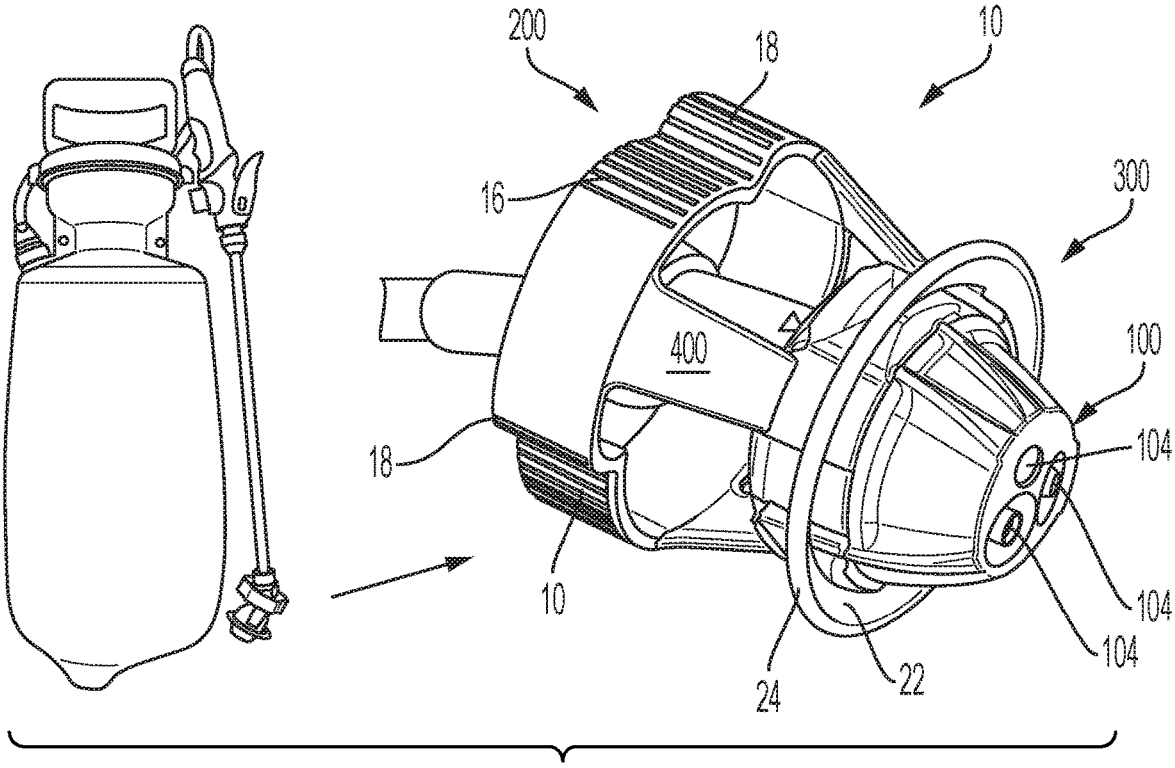
FIG. 4 is a perspective view of an adjustable nozzle as used on a sprayer, in accordance with an embodiment.
Figure 5A:
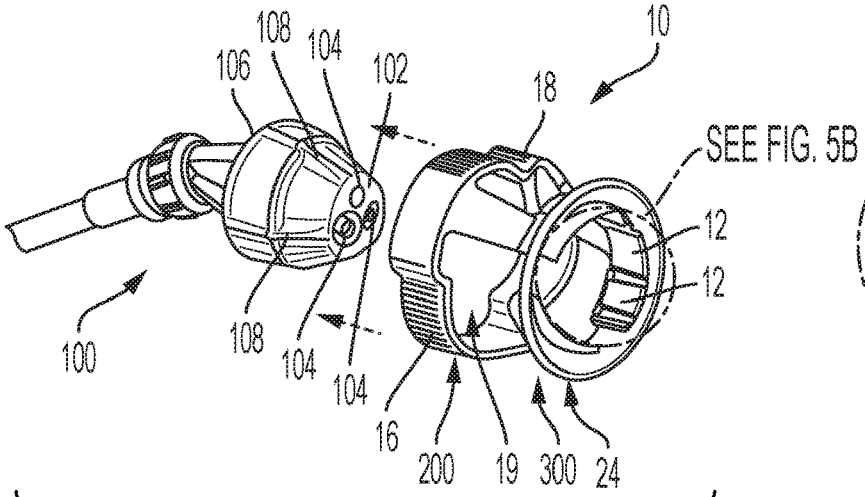
FIGS. 5(*a*)-5(*f*) illustrate sequential alignment and clasp features on a nozzle attachment, in accordance with an embodiment.
Figure 5B:
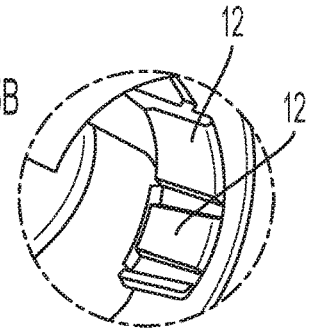
Figure 5C:
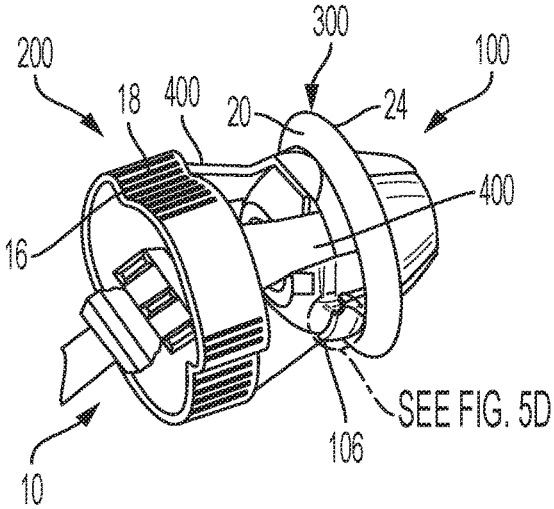
Figure 5D:
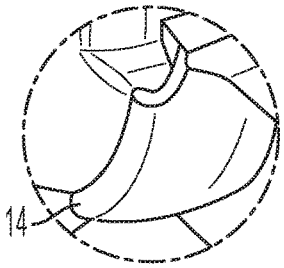
Figure 5E:
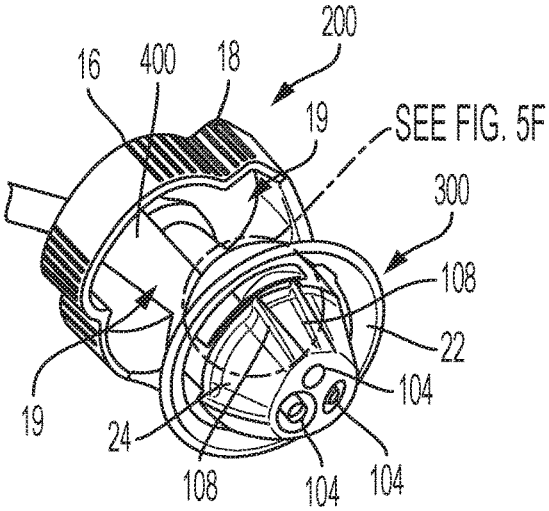
Figure 5F:
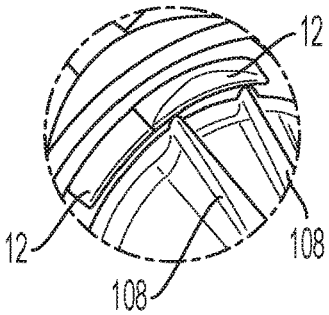

Referring to FIGS. 4 and 5(*a*)-5(*f*), in one embodiment, is a nozzle attachment 10 configured with features that both align and clamp onto an existing nozzle 100. In one embodiment, there are three sets of alignment 12 and clasping 14 features that permit alignment of the nozzle outlet 100 with the desired spray pattern and securely connect the attachment 10 to the nozzle 100, respectively.

Figure 6A:
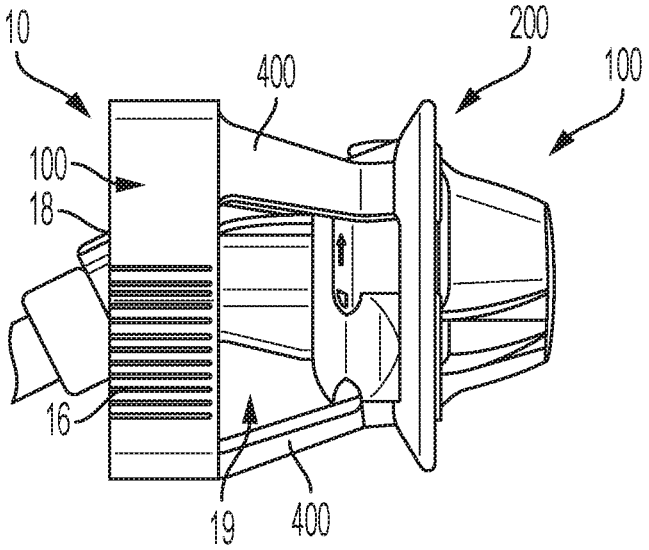
FIGS. 6(*a*) and 6(*b*) illustrates a side elevation and perspective view, respectively, of certain elements of a nozzle attachment, in accordance with an embodiment.
Figure 6B:
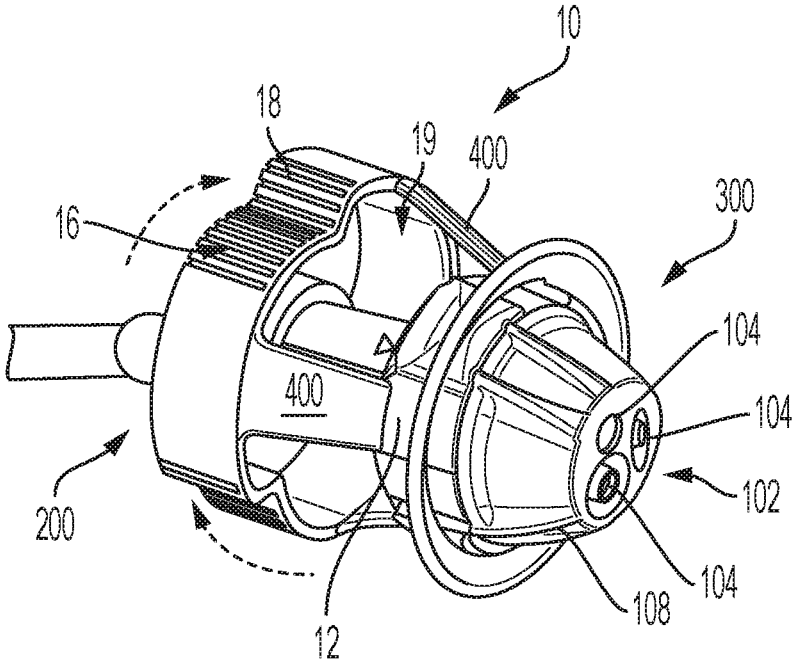

With reference to FIGS. 6(*a*) and 6(*b*), the features which comprise the nozzle attachment 10 includes a proximally positioned user engagement ring 200 and a distally positioned drip guard portion 300 that are interconnected by a series of ribs 400 that extend between the two in spaced relation to one another. Engagement ring 200 is of a proportionally larger diameter than drip guard 300.

The user engagement ring 200 comprises three (although any number could suffice) ribbed or knurled diametrical touch point features 16 that are located a predetermined distance away from the nozzle outlet 102. This location of the touch points 16 at a predetermined lateral distance from the nozzle outlet 102 when the attachment 10 is connected to the nozzle 100 minimizes the possibility of fluid reaching each touch point 16. The proportionally large diameter of engagement ring 200 as compared to drip guard 300 intuitively indicates the touch points 16 for nozzle adjustment and places the user's fingers at a radial distance away from the nozzle 100. The peripheral surface of the diametral touch point 16 may be color-coded in order to further provide an intuitive indication of the touch point. A rotation direction feature 18 comprising a ramped portion integrated into each touch point 16 encourages correct rotation of the nozzle 100 when setting the desired spray pattern. Peripheral opening view windows 19 are formed between ribs 400 and are strategically located with respect to the setting indicators 104 on the nozzle 100 when the attachment 10 is connected to the nozzle 100 thereby permitting the user to view the setting indicators while rotating the nozzle 100 without having to guess or remove the adapter 10.

The drip guard 300 comprises a bell-shaped outer feature 20 facing the user and positioned around the nozzle outlet 102 and tapering upwardly towards the distal end that discourages the user from touching or otherwise making contact with any wet surface around the nozzle outlet 102, and a bell-shaped inner feature 22 facing away from the user and directing any fluid drips and fluid collecting at the nozzle outlet 102 away from the user adjustment touch point 16. A drip edge 24 at the interface of bell inner and outer features 22, 20, respectively, provides for any collected fluid along the inner surface of the bell to readily form and drop away from the user touch point. Inner bell feature 22 and drip edge 24 together direct and divert any outlet fluid drips and nozzle surface contamination a distance L3 away from the user touch point 16.

The alignment features 12 each comprise a cantilevered, spring biased tab that correspond in position and size to contour and engage nozzle body 100 with each alignment tab 12 extending between successive ribs 108 when attachment 10 is slid onto nozzle 100. Clasping feature 14 comprises a ridged flange sized, shaped and positioned to snap over and engage the end of ridge 106 to secure the interconnection between attachment device 10 and nozzle 100.

Figure 7:
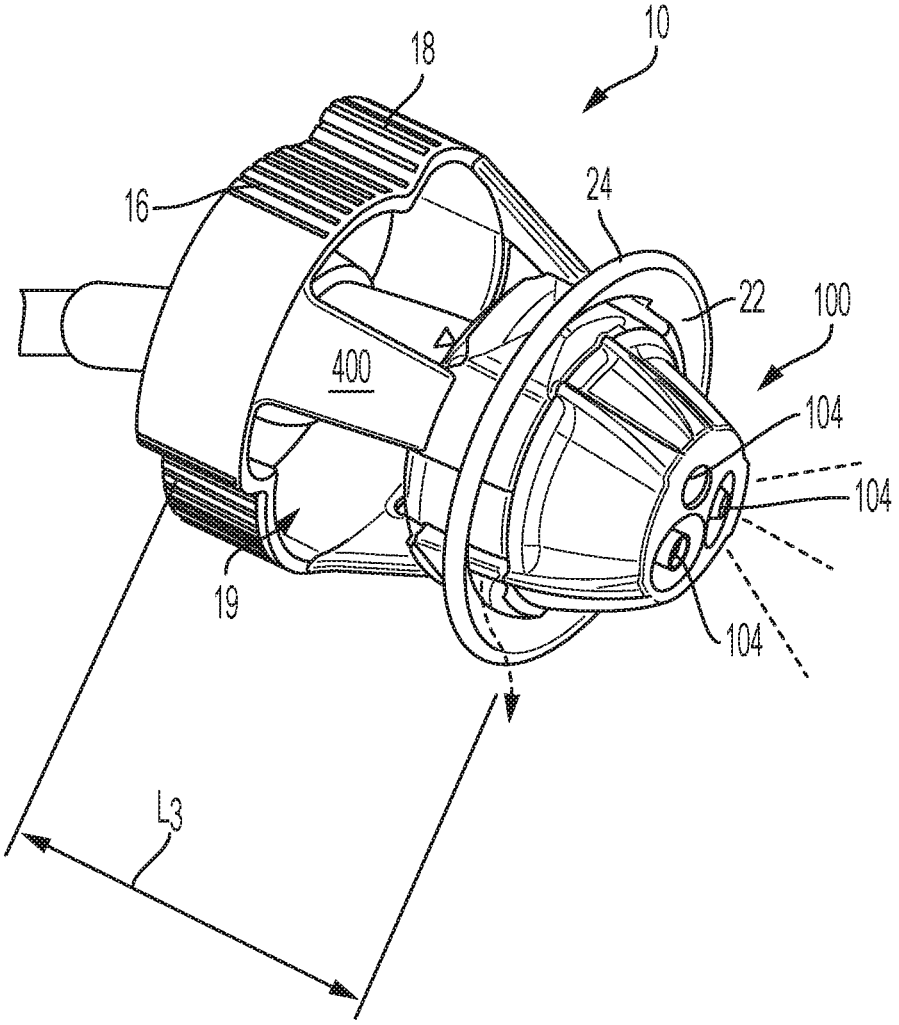
FIG. 7 illustrates in perspective certain elements of a nozzle attachment, in accordance with an embodiment.

With regard to FIG. 7 it illustrates how the features which comprise the nozzle attachment 10 are able to prevent the sprayed fluid from contact with the user's fingers during adjustment of the nozzle.

While various embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

The above-described embodiments of the described subject matter can be implemented in any of numerous ways. For example, some embodiments may be implemented using hardware, software or a combination thereof. When any aspect of an embodiment is implemented at least in part in software, the software code can be executed on any suitable processor or collection of processors, whether provided in a single device or computer or distributed among multiple devices/computers.

What is claimed is:

1. A nozzle adapter for secure placement on a nozzle having at least two spray apertures and corresponding alignment region that permit each of the spray apertures to be positioned for activation through rotation of the nozzle and alignment of the desired alignment region, the nozzle adapter comprising:

a. a body having proximal and distal portions that is sized, shaped, and adapted to be positioned in fixed relation to an exterior of the nozzle;

b. wherein the distal portion comprises:

i. at least two alignment elements that engage with the corresponding alignment region of the nozzle, wherein each of the at least two alignment elements comprise a cantilevered, spring biased tab that corresponds in position and size to contour and engage the nozzle;

ii. at least one clasping element that securely engages with the nozzle to fix a relative position of the nozzle adapted to the nozzle; and iii. a ring element attached to the distal portion and extending circumferentially there-around and positioned radially outwardly from the at least one-alignment element and the at least one-clasping element; and c. wherein the proximal portion is attached in laterally spaced relation to the distal portion by at least one outwardly tapering connector, and comprises at least two touch point regions that each terminate in an area that is raised relative to the remaining part of the area constituting a touch point and permits a user to rotate the nozzle adapter and nozzle to actuate any of the nozzle's spray apertures.

2. The nozzle adapter according to claim 1, wherein the distal portion comprises at least three alignment elements circumferentially spaced relative to one another, and at least three clasping elements circumferentially spaced relative to one another.

3. The nozzle adapter according to claim 1, wherein the touch point is textured.

4. The nozzle adapter according to claim 1, wherein the touch point is colored.

5. The nozzle adapter according to claim 1, wherein the proximal portion is of a proportionally larger diameter than the distal portion.

6. The nozzle adapter according to claim 1, wherein the proximal portion is attached in laterally spaced relation to the distal portion by at least three outwardly tapering connectors circumferentially spaced relative to one another such that the distance between the outwardly tapering connectors forms a viewing window.

7. A nozzle adapter for secure placement on a nozzle having at least two spray apertures and corresponding alignment region that permit each of the spray apertures to be positioned for activation through rotation of the nozzle and alignment of the desired alignment region, the nozzle adapter comprising:

a. a body having proximal, distal, and ring portions, that is sized, shaped, and adapted to be positioned in fixed relation to an exterior of the nozzle;

b. wherein the distal portion comprises:

i. at least two alignment elements that engage with the corresponding alignment region of the nozzle, wherein each of the at least two alignment elements comprise a cantilevered, spring biased tab that corresponds in position and size to contour and engage the nozzle; and ii. at least one clasping element that securely engages with the nozzle to fix a relative position of the nozzle adapted to the nozzle;

c. wherein the proximal portion is attached in laterally spaced relation to the distal portion by at least one outwardly tapering connector, and comprises at least two touch point regions that each terminate in an area that is raised relative to the remaining part of the area constituting the touch point and permits a user to rotate the nozzle adapter and nozzle to actuate any of the nozzle's spray apertures; and d. wherein the ring portion comprises:

i. an outer bell that is position such that it is a barrier to discourage users from grasping the distal portion;

ii. an inner bell positioned such that excess fluid on the nozzle drips into it; and iii. a drip edge positioned on the inner bell adapted to divert the excess fluid from the inner bell away from the user; and e. wherein the ring portion is attached to the distal portion extending circumferentially there-around and positioned radially outwardly from the at least one alignment element and the at least one clasping element.

8. The nozzle adapter according to claim 7, wherein the distal portion comprises at least three alignment elements circumferentially spaced relative to one another, and at least three clasping elements circumferentially spaced relative to one another.

9. The nozzle adapter according to claim 7, wherein the at least one clasping element comprises a ridged flange sized, shaped, and positioned to snap over and engage the nozzle.

10. The nozzle adapter according to claim 7, wherein the touch point is textured.

11. The nozzle adapter according to claim 7, wherein the touch point is colored.

12. The nozzle adapter according to claim 7, wherein the proximal portion is of a proportionally larger diameter than the distal portion and the ring portion.

13. The nozzle adapter according to claim 7, wherein the proximal portion is attached in laterally spaced relation to the distal portion by at least three outwardly tapering connectors circumferentially spaced relative to one another such that the distance between the outwardly tapering connectors forms a viewing window.

* * * * *